US006425311B1

(12) United States Patent
Caron

(10) Patent No.: US 6,425,311 B1
(45) Date of Patent: Jul. 30, 2002

(54) PRY-PROOF GUN PORT

(75) Inventor: Jeffrey A. Caron, Adams, MA (US)

(73) Assignees: Christopher M. Light; Gail V. Light, both of Pittsfield, MA (US)

( * ) Notice: Subject to any disclaimer, the term of this patent is extended or adjusted under 35 U.S.C. 154(b) by 9 days.

(21) Appl. No.: 09/631,020

(22) Filed: Aug. 2, 2000

(51) Int. Cl.[7] ..... F41H 5/26
(52) U.S. Cl. ..... 89/36.14; 109/58.5
(58) Field of Search ..... 89/36.14, 36.03; 109/58.5

(56) References Cited

U.S. PATENT DOCUMENTS

| | | | | | |
|---|---|---|---|---|---|
| 41,245 | A | * | 1/1864 | Trussell | |
| 3,262,227 | A | * | 7/1966 | Pentecost | 49/354 |
| 3,559,528 | A | | 2/1971 | Cunningham | |
| 4,383,473 | A | * | 5/1983 | Kaustrater | 89/40 |
| 4,574,525 | A | * | 3/1986 | Le Borgne et al. | 49/324 |
| 4,771,672 | A | * | 9/1988 | Miller | 89/36.14 |
| 4,771,673 | A | * | 9/1988 | Miller | |
| 4,771,674 | A | | 9/1988 | Miller | |
| 5,105,714 | A | * | 4/1992 | Sprafke et al. | 89/36.08 |

* cited by examiner

*Primary Examiner*—Michael L. Carone
*Assistant Examiner*—M Thomson
(74) *Attorney, Agent, or Firm*—Malcolm J. Chisholm, Jr.

(57) ABSTRACT

The invention is a pry-proof gun port for shielding a gun whenever the gun port is in a closed position and for permitting the gun to be discharged through the gun port whenever the gun port is in an open position. The gun port includes a frame mountable to a support structure such as a currency transport vehicle, the frame including an exterior mount plate that defines a discharge port dimensioned to support a closure shield. A push rod has an exterior end secured to a peripheral region of the closure shield and an intermediate portion passing through a chamber of the frame. The push rod moves axially to position the closure shield out of the discharge port, and the push rod then rotates the closure shield away from the discharge port to place the gun port in the open position. A lock rod interacts between a shoulder of the chamber of the frame and a lock shaft coaxial with and within the push rod to restrict opening of the closure shield from the exterior mount plate. An operator must move the lock shaft toward the exterior mount plate before moving the push rod so that the lock rod moves out of abutment with a shoulder of a chamber of the frame to allow the push rod to move the closure shield out of the discharge port.

20 Claims, 5 Drawing Sheets

PRY-PROOF GUN PORT

TECHNICAL FIELD

The present invention relates to apparatus for permitting discharge of a fire arm through a small port in a support structure such as a body of an armored vehicle, and in particular relates to a gun port that facilitates opening and closure of a closure shield over a discharge port by a single motion of an operator of the gun port, wherein the closure shield is mechanically secured against being pried open from an exterior side of the gun port whenever the closure shield is in a closed position.

BACKGROUND OF THE INVENTION

Gun ports are well known in the art for both military and non-military application, wherein the gun port permits discharge of a fire arm through a discharge port defined within the gun port whenever the gun port is in an open position, and secures the port against passage of a bullet or other unwanted object (e.g., a poisonous gas container) or fluid whenever the gun port is in a closed position. Typically gun ports include a closure shield secured to an exterior surface of a support apparatus such as an exterior wall of an armored vehicle for carrying bulk quantities of currency. The closure shield is often actuated by an operator of the gun port next to an interior surface of the support apparatus, such as inside the armored vehicle. If the armored vehicle were to be attacked, such as in an attempted armed robbery of the vehicle, the operator must quickly open the closure shield, pass a muzzle of a fire arm through the discharge port, and discharge the fire arm in the direction of the robbers. Most often, gun ports are located near armored windows so that the operator may observe the target while discharging the fire arm. If the operator has discharged all of the bullets in the fire arm, and must then re-load, it is imperative that the closure shield be quickly closed so that the robbers may not open the closure shield to discharge a fire arm into the vehicle, or pass into the vehicle a small explosive or poisonous gas.

Most known gun ports have closure shields that may be quickly opened and closed. For example, in U.S. Pat. No. 4,771,673 to Miller, a gun port is disclosed that utilizes a rocker arm with an attached spring wherein the spring secures a closure shield in both an open and closed position so that the operator may simply grab a knob attached to the shield and pivot the shield downward, away from the discharge port to shoot through the port. The same spring secures the shield in a closed position. The primary resistance however, to a forced opening from the exterior surface of the support structure housing the gun port is the spring, and that may be readily over come by and aggressive attacker.

U.S. Pat. No. 4,771,672, also to Miller shows a vertically sliding closure shield with a mechanical latch that may only be opened from within the vehicle. However, movement of the sliding closure shield up and out of the way of the discharge port involves a complicated locking latch lever and movement by the fire arm or operator's hand, all of which take considerable time, and hence lessen the value of the gun port. Additionally, known gun ports that include mechanical stops to resist prying are typically costly to manufacture involving many moving parts, and are typically slow to engage, taking more than one movement by the operator. Accordingly, there is a need for a pry-proof gun port that is of efficient manufacture, and that can be quickly opened, and securely closed by one simple motion by the operator of the gun port.

SUMMARY OF THE INVENTION

The invention is a pry-proof gun port for shielding a gun whenever the gun port is in a closed position and for permitting the gun to be discharged through the gun port whenever the gun port is in an open position. The gun port comprises: a frame for mounting the gun port to a support structure, such as a body of an armored vehicle, the frame including an exterior mount plate defining a discharge port dimensioned to support a closure shield, the frame also including an interior mount plate mechanically secured to the exterior mount plate and defining an access port that is coaxial with the discharge port; a push rod having an exterior end of the rod secured to a peripheral region of the closure shield, the push rod having an intermediate portion passing through a chamber of the frame, and the push rod having an interior end opposed to the exterior end wherein the interior end includes a lock shaft adjustably secured within a lock chamber defined within the interior end of the push rod so that the lock shaft is coaxial with the push rod; the lock shaft defining a raised exterior end opposed to an interior button end, and at least one notch between the raised and button ends; a lock rod secured within a throughbore of the interior end of the push rod perpendicular to the push rod and lock shaft so that an upper end of the lock rod abuts a shoulder of the chamber of the frame whenever a lower end of the lock rod contacts the raised exterior end of the lock shaft.

The chamber of the frame, the push rod, lock shaft, and the lock rod are cooperatively dimensioned so that whenever the lock shaft is pushed toward the exterior end of the push rod, the lower end of the lock rod moves into the notch of the lock shaft and the upper end of the lock rod moves out of abutment with the shoulder of the chamber toward the push rod so that the push rod may then move through the frame to push the closure shield out of the discharge port of the exterior mount plate to permit rotation by the push rod of the closure shield away from the discharge port to allow passage of a bullet through the discharge port.

Because the push rod may not move toward the exterior mount plate of the frame until the lock shaft is first moved by its interior end to permit the lock rod to move into the notch of the lock shaft, the closure shield may not be pried open from the exterior mount plate of the frame. If the exterior mount plate is secured to an exterior surface of a support structure such as an armored currency transport vehicle, and the interior end of the lock shaft is secured within the interior of the vehicle, the pry-proof gun port may only be opened from the interior of the vehicle housing the interior ends of the lock shaft and push rod.

In alternative embodiments, a first coil spring secures the push rod to the frame so that the coil spring applies a torsion force between the frame and the closure shield secured to the push rod in order to twist the closure shield away from the discharge port whenever the push rod pushes the closure shield out of the discharge port. The first coil spring also applies a tension force between the frame and the closure shield to draw the shield back into the discharge port whenever the operator rotates the push rod, against the torsion force of the coil spring, to position the closure shield back over the discharge port to close the pry-proof gun port. A second coil spring may also be included between the raised end of the lock shaft and an exterior end of the lock chamber that pushes the lock shaft away from the exterior mount plate of the frame. Additionally, the notch of the lock shaft may be a beveled notch, having a beveled edge closest to the exterior raised end of the shaft to facilitate movement of the lock rod into and out of the notch. Also, the shoulder of the chamber of the frame may be a beveled shoulder to facilitate movement of the lock rod into the notch of the shaft. In another alternative embodiment, a stop pin may be secured within the push rod that mates with a stop box defined in the frame that limits rotation of the push rod between desired limits so that the closure shield rotates away from the discharge port to a desired open position, such as one-hundred and eighty degrees from a closed position within the discharge port, and then rotates back into alignment with the discharge port to close the gun port. Also, the exterior frame plate may define an "O"-ring groove adjacent a periphery of the discharge port that houses an "O"-ring in order to secure the pry-proof gun port against passage of fluids such as poisonous gases through the port when the closure shield is in the closed position.

In moving the pry-proof gun port from the open position to the closed position, the tension force of the first coil spring also moves the push rod secured to the closure shield away from the exterior mount plate of the frame. The tension force of the second coil spring then moves the lock shaft so that its raised end slides under the lower end of the lock rod as the upper end of the lock rod moves out of the chamber of the frame thereby positioning the upper end of the lock rod to again abut the shoulder of the chamber of the frame. Therefore, the pry-proof gun port, by the combined working of the first and second coil springs, automatically moves the closure shield into the discharge port and locks the closure shield against being pried open from the exterior mount plate whenever the operator makes ones rotational movement of the push rod to move the gun port back to a closed, pry-proof position.

To move the pry-proof gun port back into the open position, the operator simply has to make one pushing movement against the button exterior end of the lock shaft and the interior end of the push rod, which are coaxial. In a preferred embodiment, the button end of the lock shaft protrudes out of the interior end of the push rod a distance that is approximately the same as a distance between the raised exterior end and the notch of the lock shaft. The initial movement of the lock shaft moves the lock rod into the notch so that the upper end of the lock rod moves out of abutment with the shoulder of the chamber of the frame. Thereafter, the push rod may move toward the exterior mount plate to move the closure shield out of the discharge port so that the first coil spring may then rotate the closure shield away from the discharge port placing the gun port in the open position. Again, one, quick pushing motion by one hand of the operator opens the gun port, while the other hand of the operator may then pass a muzzle of a fire arm through the discharge port. To quickly close and lock the pry-proof gun port, the operator simply rotates the interior end of the push rod so the closure shield overlies the discharge port, and the closure shield snaps into its closed and locked position.

Accordingly, it is a general object of the present invention to provide a pry-proof gun port that overcomes deficiencies of prior art gun ports.

It is a more specific object to provide a pry-proof gun port that permits movement from a closed position to an open position with one straight, pushing motion of an operator.

It is yet another object to provide a pry-proof gun port that provides for automatic movement from an open to a closed, pry-proof position with one rotational movement by the operator.

It is a further object to provide a pry-proof gun port that includes a fluid seal between and exterior and interior of the gun port.

It is still another object to provide a pry-proof gun port that is of efficient, compact manufacture that is easy to install in a support structure such as an armored vehicle.

These and other objects and advantages of this invention will become more readily apparent when the following description is read in conjunction with the accompanying drawings.

DESCRIPTION OF THE PREFERRED EMBODIMENTS

Figure 1:
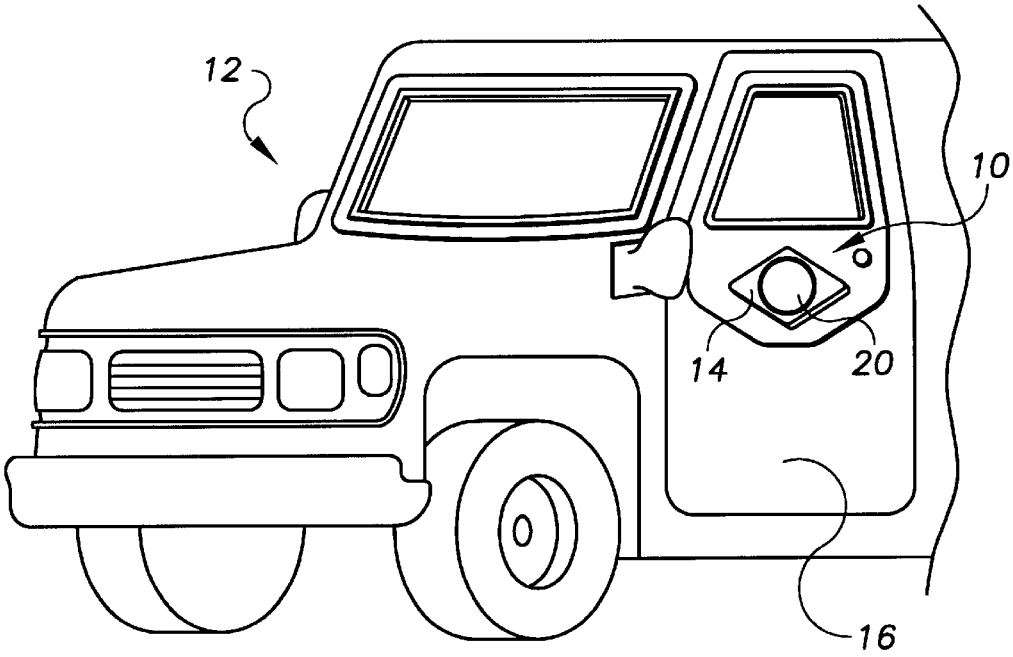
FIG. 1 is a fragmentary perspective view of an armored vehicle support structure housing a pry-proof gun port constructed in accordance with the present invention, showing the gun port in a closed position.
Figure 2:
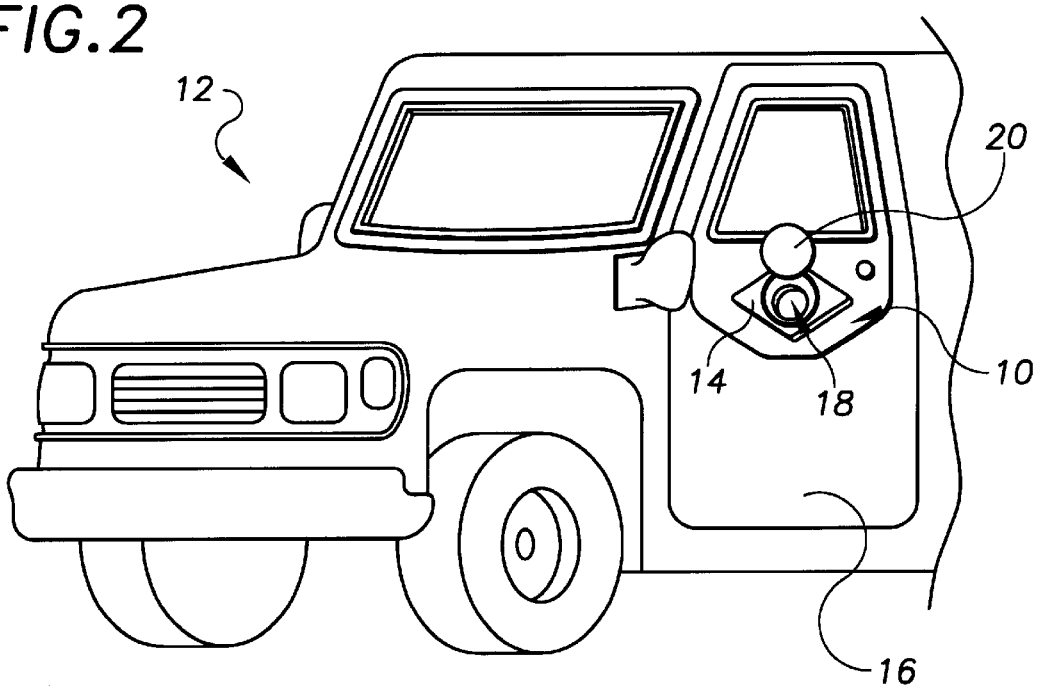
FIG. 2 is a fragmentary perspective view of the FIG. 1 pry-proof gun port showing the gun port in a closed position.

Referring to the drawings in detail, a pry-proof gun port constructed in accordance with the present invention is shown and generally designated by the reference numeral 10. As best seen in FIGS. 1 and 2, the pry-proof gun port may be secured to a support structure such as an armored vehicle 12, so that an exterior mount plate 14 of the gun port 10 is secured to an exterior surface 16 of the vehicle. The exterior mount plate 14 defines a discharge port 18 (best seen in FIG. 4) dimensioned to house and support a closure shield 20. In FIG. 1, the pry-proof gun port 10 is shown in a closed position wherein the closure shield 20 is supported within the discharge port 18. In FIG. 2, the gun port 10 is shown in an open position, wherein the closure shield 20 is rotated away from the exterior mount plate 14, to thereby permit discharge of a fire arm 22 (shown only in FIG. 6) through the discharge port 18 from within the armored vehicle, as is well known in the art.

As best shown in FIGS. 3–6, the pry-proof gun port 10 includes a frame 24 for mounting the gun port 10 to the support structure 12, such as an exterior surface 16 of an armored vehicle 12. The frame includes the exterior mount plate 14 defining the discharge port 18, and in the embodiments shown in FIGS. 3–6, the frame also includes an interior mount plate 26 mechanically secured by a first strut 28 and a second strut 30 to the exterior mount plate 14, wherein the interior mount plate defines an access port 32 coaxial with the discharge port 18. The interior mount plate may include fastening means for securing the frame 24 to the support structure 12, such as a first bolt slot 34 (shown in FIG. 5) and first bolt 36, and second bolt slot (not shown) and second bolt 38 (shown in FIGS. 3 and 4).

The pry-proof gun port 10 also includes a push rod 40 (shown best in FIGS. 5 and 6) having an exterior end 42 secured to a peripheral region of the closure shield 20; having an intermediate portion 44 passing through a chamber 46 of the frame 24; and, the push rod 40 having an interior end 48 opposed to the exterior end 42 that defines a lock chamber 50 dimensioned to house a lock shaft 52 so that the lock shaft 52 is coaxial with the push rod 40. The lock shaft 52 includes a raised exterior end 54 opposed to an interior button end 56 and a notch 58 defined adjacent the raised exterior end 54. A lock rod 60 is secured within a throughbore 62 in the interior end 42 of the push rod 40 roughly perpendicular to the push rod 40 so that an upper end 64 of the lock rod 60 abuts a shoulder 66 of the chamber 46 of the frame 24 whenever a lower end 68 of the lock rod 60 rests on the raised exterior end 54 of the lock shaft 52.

Figure 3:
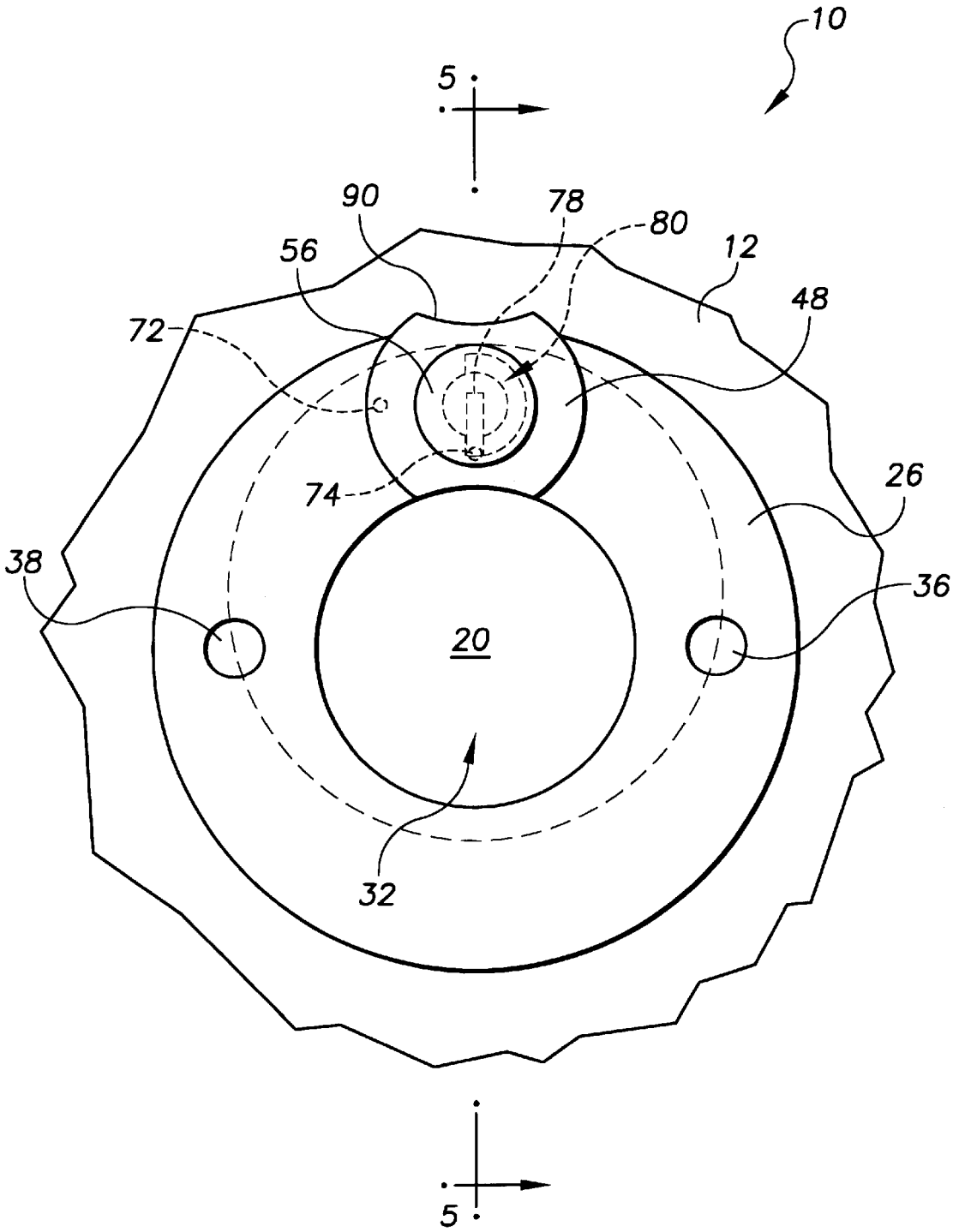
FIG. 3 is a rear plan view of a pry-proof gun port constructed in accordance with the present invention, showing the gun port in the closed position.
Figure 4:
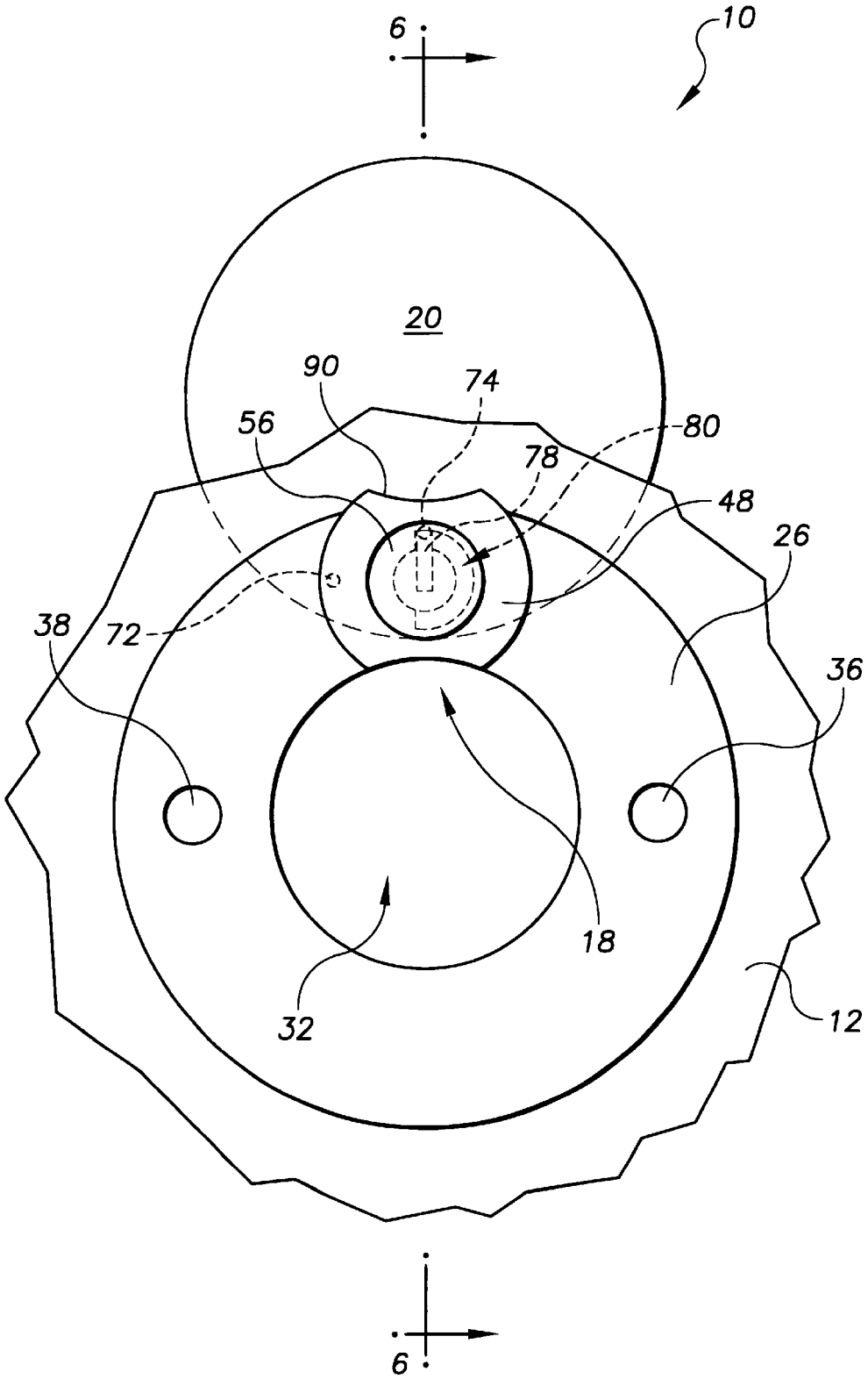
FIG. 4 is a rear plan view of the FIG. 3 pry-proof gun port showing the gun port in the open position.

A first coil spring 70 is secured to be coaxial with the push rod 40, and is biased between the push rod 40 and the frame 24 at a frame attachment slot 72 and a push rod attachment slot 74 so that the spring applies a torsion force between the frame 24 and the push rod 40 in order to rotate the closure shield 20 that is secured to the push rod 40 away from the exterior mount plate 16. For example and as best shown in FIGS. 3 and 4, whenever the push rod 40 moves the closure shield 20 out of the discharge port 18, the first coil spring 70 is secured between the frame 24 and push rod 40 so that a torsion force rotates the closure shield 20 counter clockwise (in the view provided in FIGS. 3 and 4) to approximately one-hundred and eighty degrees from the position of the closure shield 20 within the discharge port 18. The first coil spring 70 is also structured to simultaneously apply a tension force between the frame attachment point 72 and the push rod attachment point 74 tending to draw the closure shield 20 into the discharge port 18 to facilitate rapid closure of the gun port. The view of the pry-proof gun port 10 of FIG. 3 shows the gun port 10 in the closed position (as with FIGS. 1 and 5, while the view of the gun port in FIGS. 2, 4, and 6 shows the gun port in the open position. A second coil spring 76 may also be included within the lock chamber 50 of the push rod 40 disposed adjacent the raised exterior end 54 of the lock shaft 52 to bias the lock shaft away from the exterior mount plate 14 of the frame 24.

The pry-proof gun port 10 may also include a stop pin 78 secured within the push rod 40 that is dimensioned to fit within a stop box 80 defined within the frame 24, as shown in FIGS. 3–6. The stop pin 78 serves to restrict movement of the push rod 40 and the closure shield 20 secured to the push rod 40 so that the shield 20 only moves to a desired position, such as shown in FIGS. 3 and 4, wherein the closure shield 20 moves away from the discharge port 18 approximately one-hundred and eighty degrees. The stop box 80 also serves to stop movement of the push rod 40 at an appropriate position whenever an operator (not shown) rotates the push rod from its interior end 48 back to overlie the discharge port 18 to close the gun port. The frame 24 may also define an "O"-ring seal 82 adjacent a peripheral edge of the discharge port 18 in order to restrict movement of gaseous or liquid fluid through the discharge port 18 whenever the pry-proof gun port 10 is in the closed position.

Figure 5:
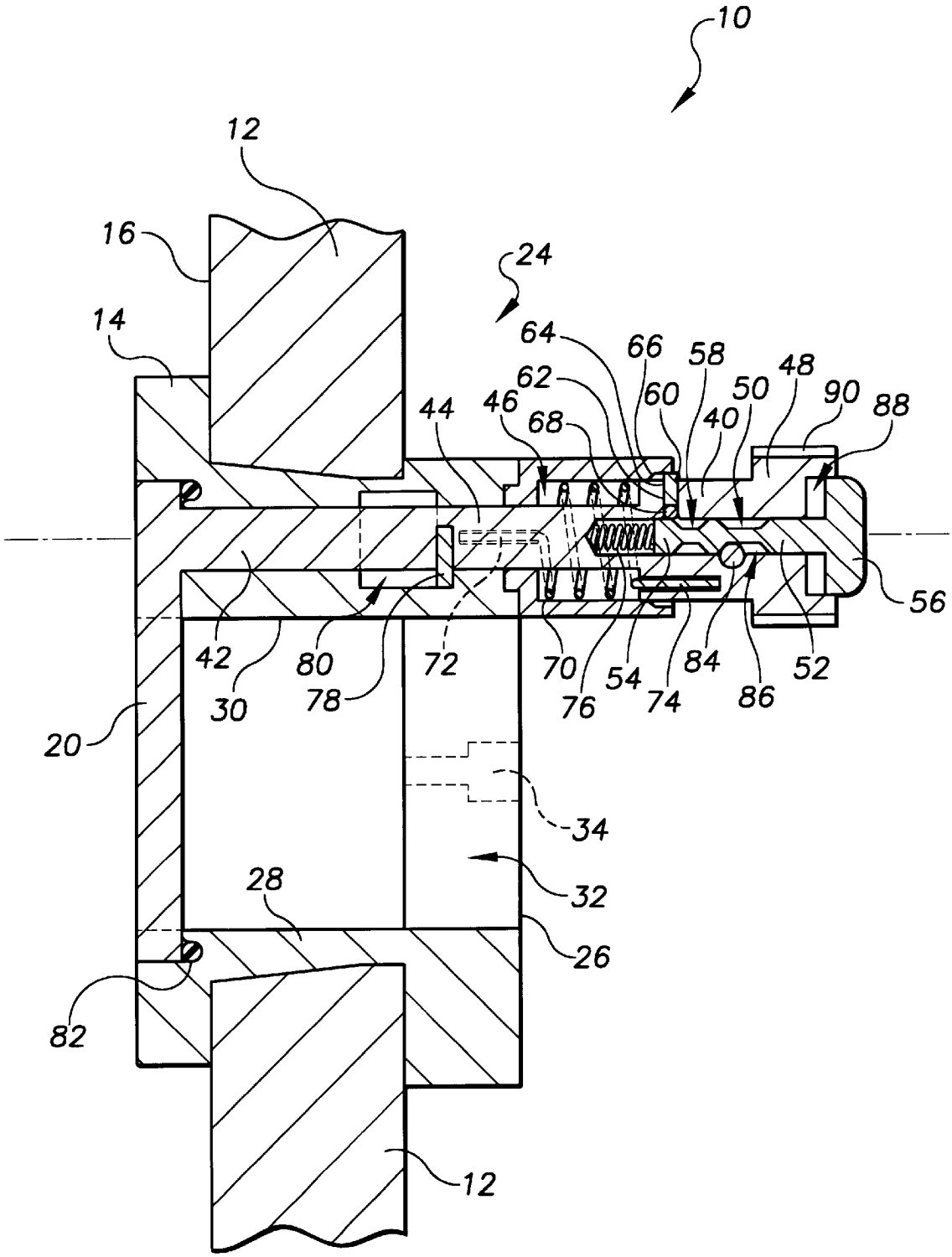
FIG. 5 is a cross-sectional side view of the FIG. 3 pry-proof gun port taken along view line 5—5 of FIG. 3.
Figure 6:
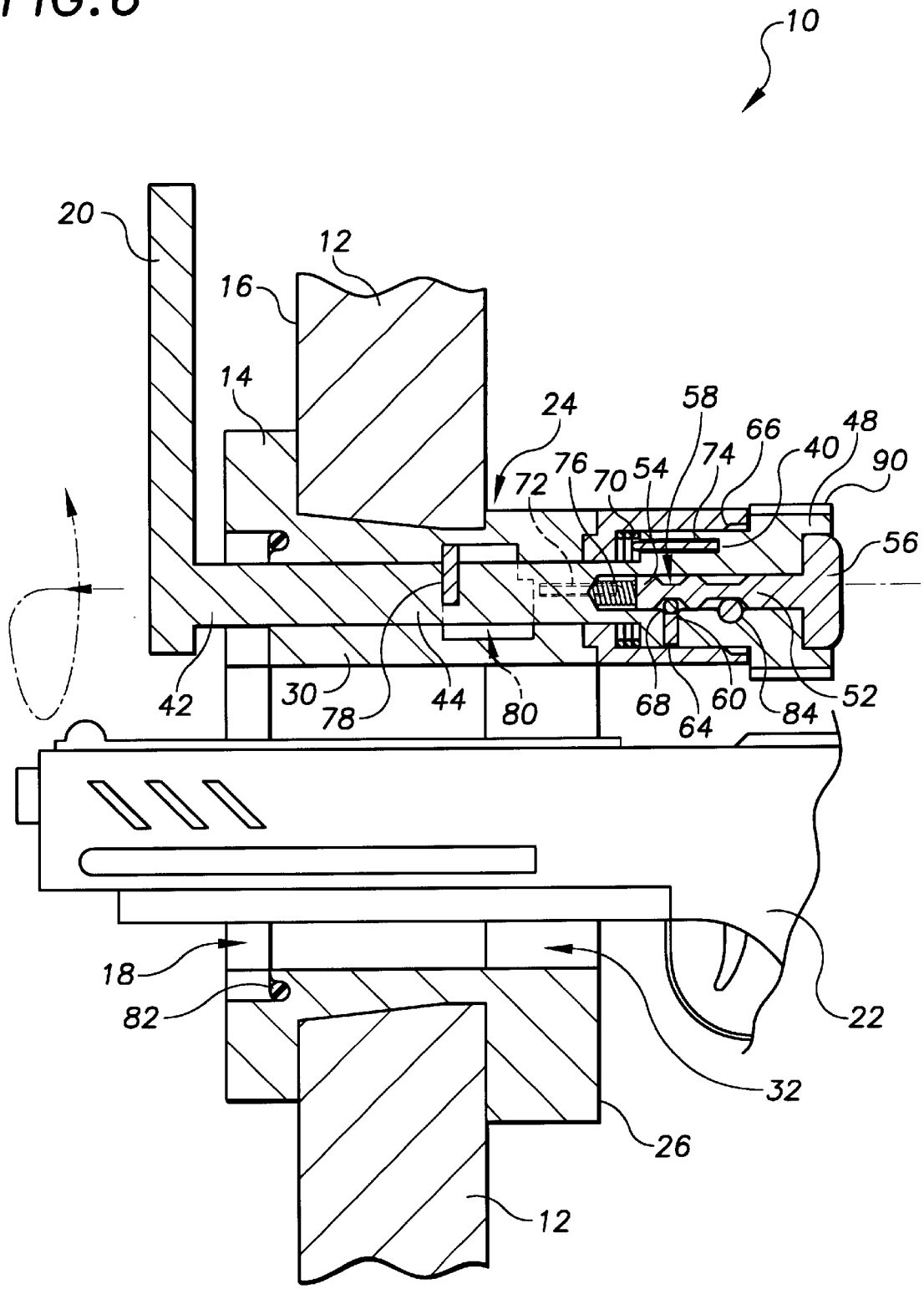
FIG. 6 is a cross-sectional side view of the FIG. 4 pry-proof gun port taken along view line 6—6 of FIG. 4.

In a preferred embodiment, and as shown in FIGS. 5 and 6, the notch 58 of the lock shaft 52 may be a beveled notch 58 having a beveled edge adjacent the raised exterior end of the lock shaft 52 to facilitate movement of the lower end 68 of the lock rod 60 out of the notch 58 and back onto the raised exterior end 54 of the lock shaft 52 when the push rod 40 is moved away from the exterior mount plate 14 to close the gun port 10. As is apparent from FIGS. 5 and 6, the second coil spring 76 assists in moving the lock shaft 52 away from the exterior mount plate 14 to thereby further assist movement of the lower end 68 of the lock rod 60 up onto the raised exterior end 54 of the lock shaft 54. Additionally, the lower end 68 of the lock rod 60 may be a roller or ball bearing 68 to assist in movement of the lock rod 60 into the notch 58 of the lock shaft 52. To further facilitate movement of the lock rod 60 into the notch 58 as the push rod 40 is moved toward the exterior mount plate 14, the shoulder 66 of the frame 24 that serves to define the chamber 46 in the frame 24 may also be beveled so that movement of the lock rod 60 into the notch 58 of the lock shaft 52 does not depend exclusively upon gravity. Instead, the beveled shoulder 66 of the frame chamber 46 gradually applies a downward pressure upon the lock rod 60 towards the notch 58 of the lock shaft 52.

As also shown in FIGS. 5 and 6, an assembly pin 84 may be secured within a securing cavity 86 defined between the lock shaft 52 and the interior end 48 of the push rod 40 within or adjacent to the lock chamber 50 to secure the lock shaft 52 within the lock chamber 50. By driving the assembly pin 84 out of the securing cavity 86, the lock shaft 52 may be removed from the push rod 40, and to assemble the lock shaft 52 within the lock chamber 50 the assembly pin 84 is simply secured within the securing cavity 86, such as by a securing means known in the art, including corresponding screws and thread, welding, etc.

As is apparent from FIGS. 5 and 6 in particular, the chamber 46 of the frame 24, the push rod 40, the lock shaft 52 and the lock rod 40 are cooperatively dimensioned so that whenever the lock shaft 52 is pushed toward the exterior mount plate 14, the lower end 68 of the lock rod 60 moves into the notch 58 of the lock shaft 52 the upper end 64 of the lock rod 60 thereby moves out of abutment with the shoulder 66 of the frame chamber 46. Because the lock rod 60 no longer contacts the shoulder 66 of the frame, the push rod 40 may then move toward the exterior mount plate 14, to move the closure shield 20 out of the discharge port 18 defined by the exterior mount plate 14 to thereby permit rotation of the closure shield 20 away from the discharge port 18 and hence permit passage of a bullet from the fire arm 22 through the discharge port 18. In a preferred embodiment, the button end 56 of the lock shaft 52 is structured to protrude out of the interior end 48 of the push rod 40 a distance that is approximately the same as a distance between the raised exterior end 54 of the lock shaft 52 and the notch 58 of the shaft 52. With such an arrangement, an operator may simply push the button end 56 of the lock shaft 52 into a seat 88 defined within the interior end 48 of the push rod 40 so that the button end is then flush mounted in the push rod 40 to facilitate a single hand pushing motion that sequentially moves the lock shaft 52 to permit movement of the lock rod 40 out of abutment with the shoulder 66 of the chamber 46 of the frame, and then in the same movement pushes the push rod 40 toward the exterior mount plate 14 to drive the closure shield 20 out of the plate 14 to thereby, in one simple pushing motion, change the pry-proof gun port 10 from the closed to the open position.

In quickly changing the gun port 10 back to the closed position, an operator simply has to rotate the interior end 48 of the push rod back against the torsion force of the first coil spring 70 to align the closure shield 20 with the discharge port 18. The stop pin 78 and stop box 80 are structured to stop rotation of the push rod 40 as the point where the closure shield 20 is aligned over the discharge port 18. By application of a tension force between the frame 24 and the push rod 40, the first coil spring 70 then snaps the closure shield 20 back into the discharge port 18 to close the gun port 10. Simultaneously, as the push rod 40 moves away from the exterior mount plate 14, the beveled notch 58 of the lock shaft 52 moves the lock rod 60 up onto the raised exterior end 54 of the lock shaft 52 whenever the lock rod 60 moves with the push rod 40 out of the chamber 46 of the frame 24, thereby forcing the upper end 64 of the lock rod 60 to again abut the shoulder 66 of the chamber 46 of the frame 24. Consequently, the pry-proof gun port 10 automatically, and almost instantly closes and locks the closure shield 20 against any effort to pry the shield open from adjacent the exterior surface 16 of the support structure 12, such as an armored vehicle.

The pry-proof gun port 10 of the present invention may be fabricated of materials common to the armored vehicle arts, such as well known hardened steels and stainless steels, etc. In a compact and efficient assembly, the gun port 10 provides for extremely rapid operation. While holding a fire arm in one hand, the operator need only push sharply upon the button end 56 of the lock shaft 52 and upon the surrounding interior end 48 of the push rod 40 at the same time to open the gun port 10 in less than one second. The fire arm may then be extended into the discharge port 18 to commence firing. Upon use of all of the bullets in the fire arm or for other reasons such as the target being no longer accessible, the operator simply withdraws the fire arm, and twists the interior end 48 of the push rod 40 approximately one-half turn, and the closure shield will then automatically slam into the discharge port, while at the same time the lock rod 60 automatically locks the closure shield 20 from being pried open. As shown in FIGS. 5 and 6, the interior end 48 of the push rod 40 may formed into an expanded hand grip 90 dimensioned to effectively fit into the operator's hand to maximize grip pressure for rotation of the hand grip to close the pry-proof gun port 10. The hand grip may also be knurled or other wise formed with finger or grip slots (not shown) to enhance grip force by the operator upon the push rod 40 to facilitate rotation against substantial torsion force of a strong first coil spring 70 selected to apply substantial force to a heavy closure shield 20.

While the present invention has been described and illustrated with respect to a particular construction and illustration of preferred embodiments of a pry-proof gun port it should be understood that the invention is not limited to the described and illustrated examples. For example, while movement of the lock rod 60 is facilitated by the described beveled notch 58 and beveled shoulder 66 of the chamber 46 of the frame 24, alternative mechanical structures could likewise move the lock rod from a pry-proof, closed position wherein the lock rod abuts the shoulder 66 of the frame 24 to an open position wherein the lock rod 60 moves into a notch, cavity or throughbore of the lock shaft 52 thereby permitting movement of the lock rod 60 into the cavity 66 so that the push rod 40 may then push the closure shield out of the discharge port 18. Additionally, while the first coil spring 70 facilitates automatic opening and closing of the pry-proof gun port 10, the invention includes embodiments wherein an operator simply manually or mechanically moves the button end 56 of the lock shaft and the interior end 48 of the push rod 40 to move the closure shield 20 out of the discharge port 18, and then manually rotates the closure shield 20 away from the discharge port 18. Accordingly, reference should be made primarily to the attached claims rather than to foregoing description to determine the scope of the invention.

What is claimed is:

1. A pry-proof gun port for shielding a gun whenever the gun port is in a closed position, and for permitting a bullet of the gun to be discharged through the gun port whenever the gun port in an open position, the pry-proof gun port comprising:

a. a frame for mounting the pry-proof gun port to a support structure, the frame including an exterior mount plate that defines a discharge port dimensioned to support a closure shield;

b. a push rod having an exterior end of the push rod secured to a peripheral region of the closure shield, the push rod having an intermediate portion passing through a chamber of the frame, and the push rod having an interior end opposed to the exterior end of the push rod;

c. a lock shaft adjustably secured within a lock chamber defined within the interior end of the push rod, the lock shaft defining a raised exterior end opposed to an interior button end and a notch between the raised exterior end and the interior button end;

d. a lock rod secured within a throughbore in the interior end of the push rod perpendicular to the push rod and lock shaft so that an upper end of the lock rod abuts a shoulder of the chamber of the frame whenever a lower end of the lock rod contacts the raised exterior end of the lock shaft; and, e. the frame, push rod, lock shaft and lock rod being cooperatively dimensioned so that whenever the lock shaft is moved toward the exterior end of the push rod, the lower end of the lock rod moves into the notch of the lock shaft and the upper end of the lock rod moves out of abutment with the shoulder of the chamber of the frame so that the push rod may then move toward the exterior mount plate to push the closure shield out of the discharge port of the exterior mount plate to permit rotation by the push rod of the closure shield away from the discharge port to permit passage of a bullet through the discharge port.

2. The pry-proof gun port of claim 1, wherein the notch defined within the lock shaft is a beveled notch having a beveled edge adjacent the raised exterior end of the lock shaft to facilitate movement of the lower end of the lock rod out of the notch and onto the raised exterior end of the shaft.

3. The pry-proof gun port of claim 1, further comprising a first coil spring secured between the frame and the push rod so that the first coil spring applies a torsion force to rotate the closure shield away from the discharge port whenever the push rod moves the closure shield out of the discharge port of the exterior mount plate of the frame.

4. The pry-proof gun port of claim 1, wherein the shoulder of the frame that defines the chamber is a beveled shoulder to facilitate movement of the lock rod from the raised end of the lock shaft into the notch defined in the lock shaft.

5. The pry-proof gun port of claim 1, wherein the button interior end of the lock shaft protrudes in a direction away from the exterior mount plate out of a seat defined within the interior end of the push rod a distance that is approximately the same as a distance between the raised exterior end of the lock shaft and the notch defined within the lock shaft.

6. The pry-proof gun port of claim 1, wherein the gun port includes a second coil spring secured between the raised exterior end of the lock shaft and an end of the lock chamber closest to the exterior mount plate so that the second coil spring tends to force the lock shaft away from the exterior mount plate of the frame.

7. The pry-proof gun port of claim 1, further comprising a stop pin secured within the push rod that is dimensioned to fit within a stop box defined within the frame so that the stop pin limits rotational movement of the push rod.

8. The pry-proof gun port of claim 1, further comprising a first coil spring secured between the frame and the push rod so that the first coil spring applies a tension force between the push rod and the frame tending to move the push rod away from the exterior mount plate of the frame.

9. A pry-proof gun port for shielding a gun whenever the gun port is in a closed position, and for permitting a bullet of the gun to be discharged through the gun port whenever the gun port in an open position, the pry-proof gun port comprising:

a. a frame for mounting the pry-proof gun port to a support structure, the frame including an exterior mount plate that defines a discharge port dimensioned to support a closure shield;

b. a push rod having an exterior end of the push rod secured to a peripheral region of the closure shield, the push rod having an intermediate portion passing through a chamber of the frame, and the push rod having an interior end opposed to the exterior end of the push rod;

c. a lock shaft adjustably secured within a lock chamber defined within the interior end of the push rod, the lock shaft defining a raised exterior end opposed to an interior button end and a beveled notch between the raised exterior end and the interior button end, the beveled notch having a beveled edge adjacent the raised exterior end of the lock shaft; and, d. a lock rod secured within a throughbore in the interior end of the push rod perpendicular to the push rod and lock shaft, the lock rod dimensioned so that an upper end of the lock rod abuts a shoulder of the chamber of the frame whenever a lower end of the lock rod contacts the raised exterior end of the lock shaft and the upper end of the lock rod is out of abutment with the shoulder of the chamber whenever a lower end of the lock rod moves into the beveled notch of the lock shaft.

10. The pry-proof gun port of claim 9, further comprising a first coil spring secured between the frame and the push rod so that the first coil spring applies a torsion force to rotate the closure shield away from the discharge port whenever the push rod moves the closure shield out of the discharge port of the exterior mount plate of the frame.

11. The pry-proof gun port of claim 10, wherein the first coil spring is secured between the frame and the push rod so that the first coil spring applies a tension force between the push rod and the frame tending to move the push rod away from the exterior mount plate of the frame.

12. The pry-proof gun port of claim 11, wherein the shoulder of the frame that defines the chamber is a beveled shoulder to facilitate movement of the lock rod from the raised end of the lock shaft into the beveled notch defined in the lock shaft.

13. The pry-proof gun port of claim 12, wherein the button interior end of the lock shaft protrudes in a direction away from the exterior mount plate out of a seat defined within the interior end of the push rod a distance that is approximately the same as a distance between the raised exterior end of the lock shaft and the notch defined within the lock shaft.

14. The pry-proof gun port of claim 13, wherein the gun port includes a second coil spring secured between the raised exterior end of the lock shaft and an end of the lock chamber closest to the exterior mount plate so that the second coil spring tends to force the lock shaft away from the exterior mount plate of the frame.

15. The pry-proof gun port of claim 14, further comprising a stop pin secured within the push rod that is dimensioned to fit within a stop box defined within the frame so that the stop pin limits rotational movement of the push rod.

16. A pry-proof gun port for shielding a gun whenever the gun port is in a closed position, and for permitting a bullet of the gun to be discharged through the gun port whenever the gun port in an open position, the pry-proof gun port comprising:

a. a frame for mounting the pry-proof gun port to a support structure, the frame including an exterior mount plate that defines a discharge port dimensioned to support a closure shield;

b. a push rod having an exterior end of the push rod secured to a peripheral region of the closure shield, the push rod having an intermediate portion passing through a chamber of the frame, and the push rod having an interior end opposed to the exterior end of the push rod;

c. a lock shaft adjustably secured within a lock chamber defined within the interior end of the push rod, the lock shaft defining a raised exterior end opposed to an interior button end and a notch between the raised exterior end and the interior button end;

d. a lock rod secured within a throughbore in the interior end of the push rod perpendicular to the push rod and lock shaft, the lock rod dimensioned so that an upper end of the lock rod abuts a shoulder of the chamber of the frame whenever a lower end of the lock rod contacts the raised exterior end of the lock shaft and the upper end of the lock rod is out of abutment with the shoulder of the chamber whenever a lower end of the lock rod moves into the notch of the lock shaft; and, e. a first coil spring secured between the frame and the push rod so that the first coil spring applies a torsion force to rotate the closure shield away from the discharge port whenever the push rod moves the closure shield out of the discharge port of the exterior mount plate of the frame to place the pry-proof gun port in the open position, and the first coil spring also applies a tension force between the push rod and the frame tending to move the push rod away from the exterior mount plate of the frame to move the closure plate into the discharge port to place the gun port in the closed position.

17. The pry-proof gun port of claim 16, wherein the notch defined within the lock shaft is a beveled notch having a beveled edge adjacent the raised exterior end of the lock shaft to facilitate movement of the lower end of the lock rod out of the notch and onto the raised exterior end of the shaft.

18. The pry-proof gun port of claim 17, wherein the shoulder of the frame that defines the chamber is a beveled shoulder to facilitate movement of the lock rod from the raised end of the lock shaft into the notch defined in the lock shaft.

19. The pry-proof gun port of claim 18, wherein the button interior end of the lock shaft protrudes away from the exterior mount plate out of a seat defined within the interior end of the push rod a distance that is approximately the same as a distance between the raised exterior end of the lock shaft and the beveled notch defined within the lock shaft.

20. The pry-proof gun port of claim 19, further comprising a stop pin secured within the push rod that is dimensioned to fit within a stop box defined within the frame so that the stop pin limits rotational movement of the push rod.

* * * * *